US008215064B2

(12) United States Patent
Diacono

(10) Patent No.: US 8,215,064 B2
(45) Date of Patent: Jul. 10, 2012

(54) SHOWER VANITY

(75) Inventor: Dewain J. Diacono, Walled Lake, MI (US)

(73) Assignee: Dewain J. Diacono, Walled Lake, MI (US)

( * ) Notice: Subject to any disclaimer, the term of this patent is extended or adjusted under 35 U.S.C. 154(b) by 317 days.

(21) Appl. No.: 12/714,676

(22) Filed: Mar. 1, 2010

(65) Prior Publication Data

US 2010/0146698 A1 Jun. 17, 2010

Related U.S. Application Data

(63) Continuation-in-part of application No. 11/736,026, filed on Apr. 17, 2007, now abandoned.

(51) Int. Cl.
*A47K 3/00* (2006.01)

(52) U.S. Cl. ..... 52/34; 52/35; 52/29; 52/63; 4/605

(58) Field of Classification Search ..... 52/34, 35, 52/63, 29, 207, 210; 4/605; 312/242, 139.2, 312/228.1, 245

See application file for complete search history.

(56) References Cited

U.S. PATENT DOCUMENTS

| | | | | |
|---|---|---|---|---|
| 1,876,407 | A | | 9/1932 | Frazier |
| 2,578,096 | A | | 12/1951 | Smith |
| 2,792,053 | A | | 5/1957 | Kursman |
| 3,004,815 | A | * | 10/1961 | O'Kain et al. ..... 312/242 |
| 3,314,741 | A | | 4/1967 | Litner |

* cited by examiner

*Primary Examiner* — William Gilbert
*Assistant Examiner* — Patrick Maestri
(74) *Attorney, Agent, or Firm* — Gifford, Krass, Sprinkle, Anderson & Citkowski, P.C.

(57) ABSTRACT

A shower vanity for use with a wall having spaced apart framing members. The vanity includes a housing dimensioned to be recessed between two adjacent framing members in the wall and the housing is attached to the framing members by fasteners. The housing includes an open front forming a cavity dimensioned to contain bathing products. Two mirrored doors are slidably mounted to the housing which cover the housing front when closed and provide access to the bathing products when opened.

9 Claims, 6 Drawing Sheets

SHOWER VANITY

CROSS-REFERENCE TO RELATED APPLICATIONS

This application is a continuation-in-part of U.S. patent application Ser. No. 11/736,026 filed Apr. 17, 2007, which claims priority of U.S. Provisional Patent Application No. 60/792,708 filed Apr. 18, 2006, which is incorporated herein by reference.

BACKGROUND OF THE INVENTION

I. Field of the Invention

The present invention relates to a shower vanity for containing bathing products.

II. Description of Related Art

People often use a variety of different bathing products while showering. These bathing products include, for example, shampoo, hair conditioner, soap, soap gels, shaving supplies and the like.

Previously, there have been no convenient devices for storing such bathing products within the shower. Consequently, such bathing products were simply left on the floor of the shower which provides an unsightly appearance.

SUMMARY OF THE PRESENT INVENTION

The present invention provides a shower vanity which overcomes the previously known disadvantages of storing bathing products within a shower.

In brief, the shower vanity of the present invention comprises a housing which is dimensioned to be recessed between two adjacent framing members, oftentimes called studs. Such studs are often spaced at 16 inches on center so that preferably the housing has a width of less than about 14⅜ inches.

The housing includes an open front and forms a cavity which is dimensioned to receive the bathing products. Optionally, one or more shelves extend laterally across the interior cavity of the housing.

The housing also includes a front mounting flange which extends outwardly from the open front of the housing. This mounting flange includes portions which flatly abut against the shower wall.

At least one fastener, and preferably six fasteners, extend through the housing and into the framing member to secure the housing to the framing member. The fasteners may extend through the housing mounting flange or, alternatively, through the interior of the housing and into the framing member.

Two mirrored doors slide in a track on opposite sides of the housing. The door is movable between an open position and a closed position. In its closed position, the door extends across and covers the open front of the housing thus obscuring the bathing products contained within the housing cavity from view. Conversely, upon sliding the housing door to its open position, access to the bathing products contained within the interior cavity of the housing is enabled. The doors are also preferably removable for easy cleaning.

Preferably, the housing and flange are of a two piece plastic construction.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF AN EMBODIMENT OF THE PRESENT INVENTION

Figure 1:
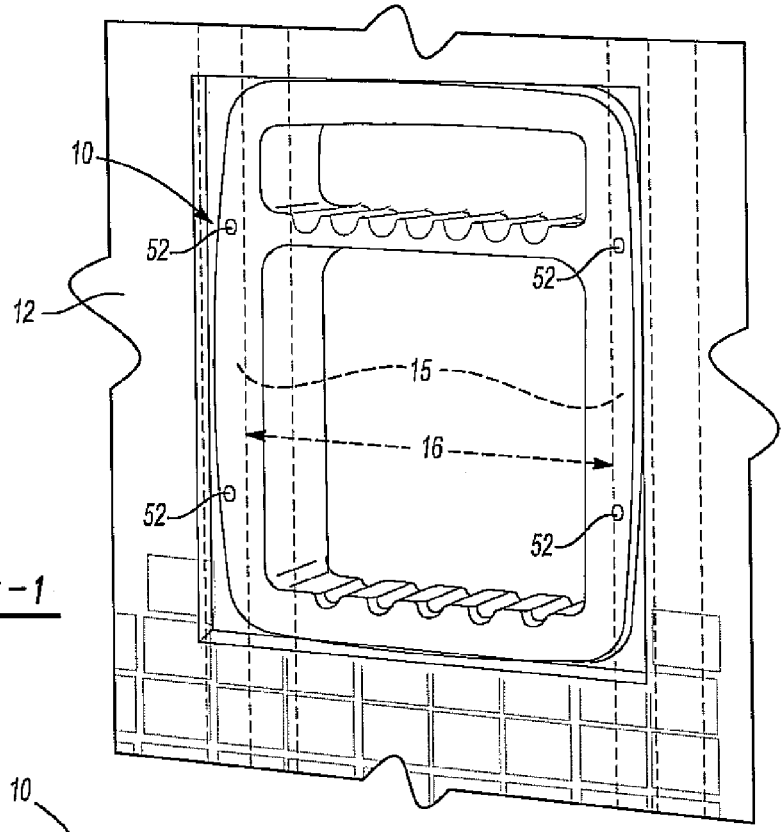
FIG. 1 is a fragmentary elevational view illustrating a preferred embodiment of the present invention installed within a shower.

With reference first to FIG. 1, a preferred embodiment of a shower vanity 10 is illustrated installed in a wall 12 of a shower. The wall 12, furthermore, includes a plurality of vertically extending and spaced apart framing members 15 which support the wall.

The framing members 15, oftentimes called studs, are typically spaced apart from each other on 16 inch centers. Since the framing members are oftentimes constructed of 2×4 lumber, the spacing 16 between framing members 15 is approximately 14⅜ inches.

Figure 2:
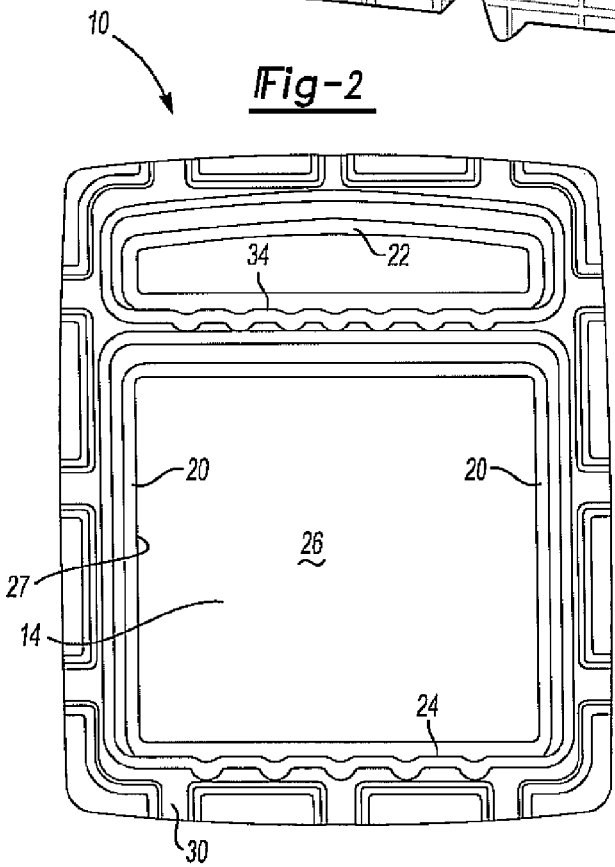
FIG. 2 is a front plan view of a preferred embodiment of the invention and with parts removed for clarity.
Figure 3:
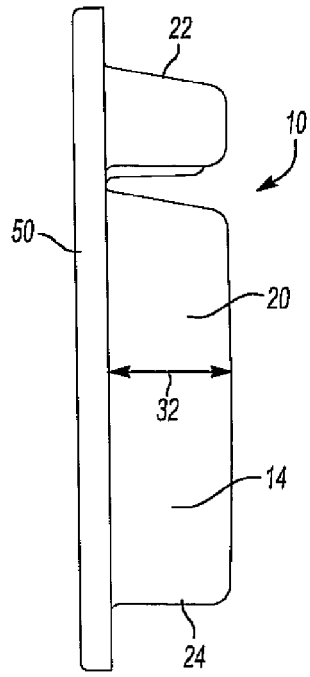
FIG. 3 is a side view of a preferred embodiment of the present invention.
Figure 4:
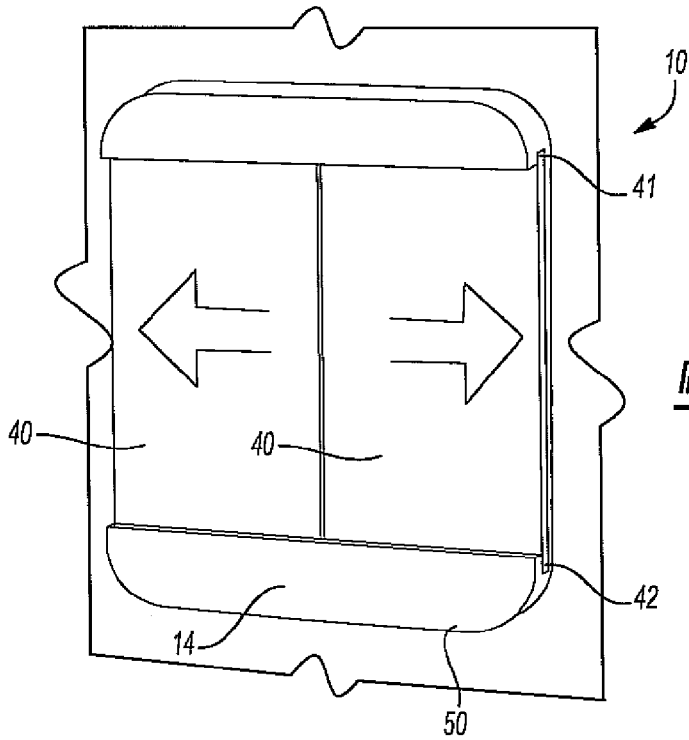
FIG. 4 is a front plan view of a preferred embodiment of the present invention.
Figure 5:
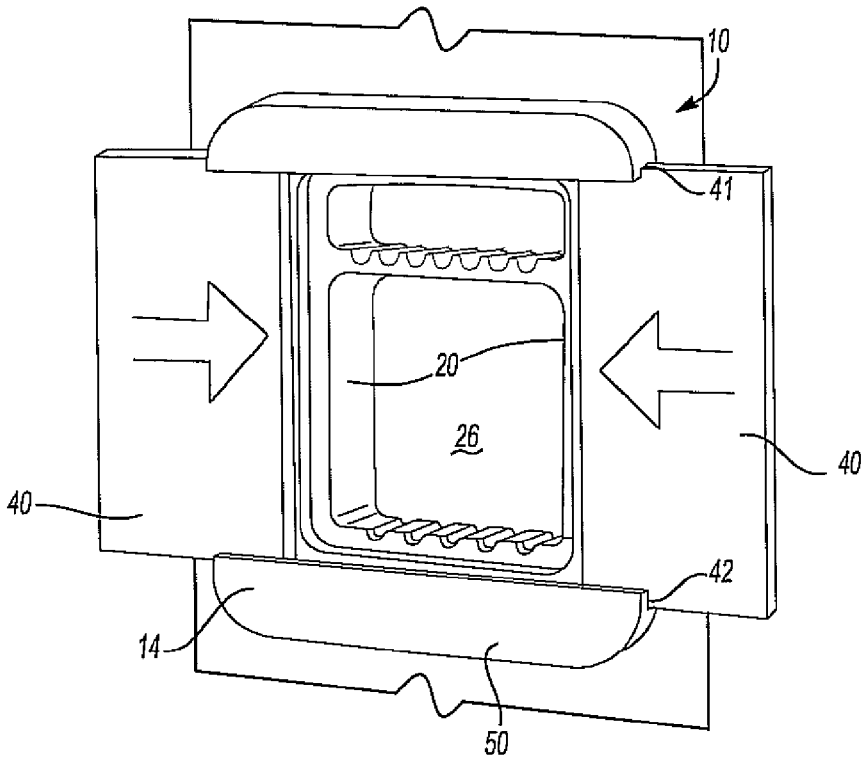
FIG. 5 is a view similar to FIG. 4, but illustrating the doors in an open position.

With reference now to FIGS. 2 and 3, the shower vanity 10 includes a generally rectangular housing 14 having a pair of spaced apart sides 20, a top 22 and a bottom 24. The housing sides 20, top 22 and bottom 24 thus form a cavity 26 having an open front 27 and which is dimensioned to receive bathing products.

As best shown in FIG. 2, a mounting flange 30 extends outwardly from the open front of the housing cavity 26 around the entire periphery of the housing 14. When the housing 14 is installed within a shower as illustrated in FIG. 1, this outwardly extending flange 30 flatly abuts against the shower wall 12.

With reference now to FIGS. 1-3, the shower vanity 10 is dimensioned to be recessed between two adjacent framing members 15 and so that at least a portion of its front flange 30 flatly abuts against the shower wall 12. Consequently, the spacing between the sides 20 of the housing 14 is preferably less than about 14 inches so that the housing may be positioned between two adjacent framing members 15 when the framing members 15 are mounted on about 16 inch centers.

Similarly, the width of conventional 2×4 framing members is approximately 3¾ inches. Consequently, in the preferred embodiment of the invention, the depth 32 (FIG. 3) of the housing cavity 26 is preferably less than about 3¾ inches.

With reference now particularly to FIG. 2, one or more shelves 34 optionally extend transversely between the sides 20 of the housing 14. The shelf 34 not only provides additional support for the housing 14, but also enables more convenient storage of the bathing products within the housing cavity 26. The bottom of the housing 14 tapers downwardly so that the housing cavity is self draining.

As best shown in FIG. 2, the housing 14 and flange 30 are preferably of a one piece plastic construction. Such construction is not only relatively inexpensive, but also exhibits long term durability and ease of cleaning. Any conventional manufacturing process, such as vacuum molding, may be used to form the housing 14 with its flange 30.

Figure 6:
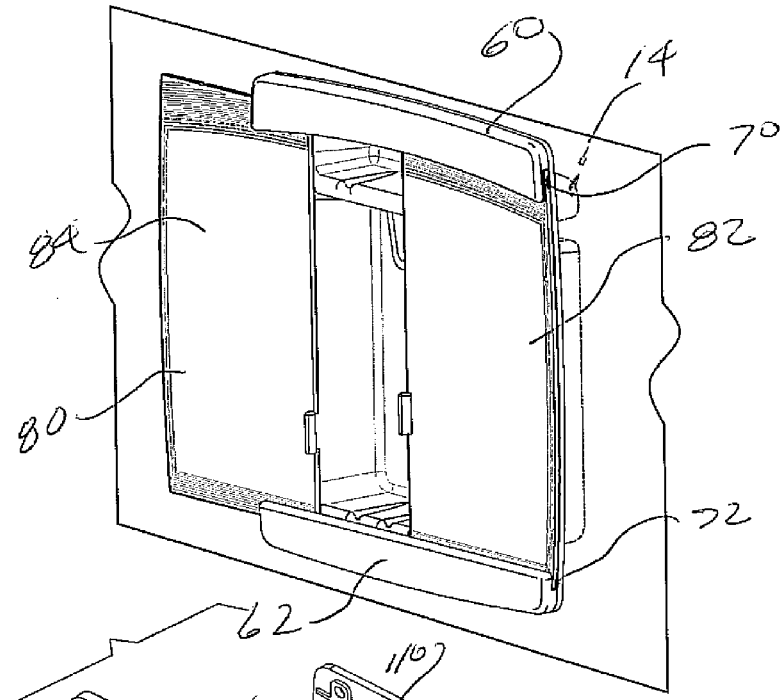
FIG. 6 is an elevational view illustrating the preferred embodiment of the invention.
Figure 7:
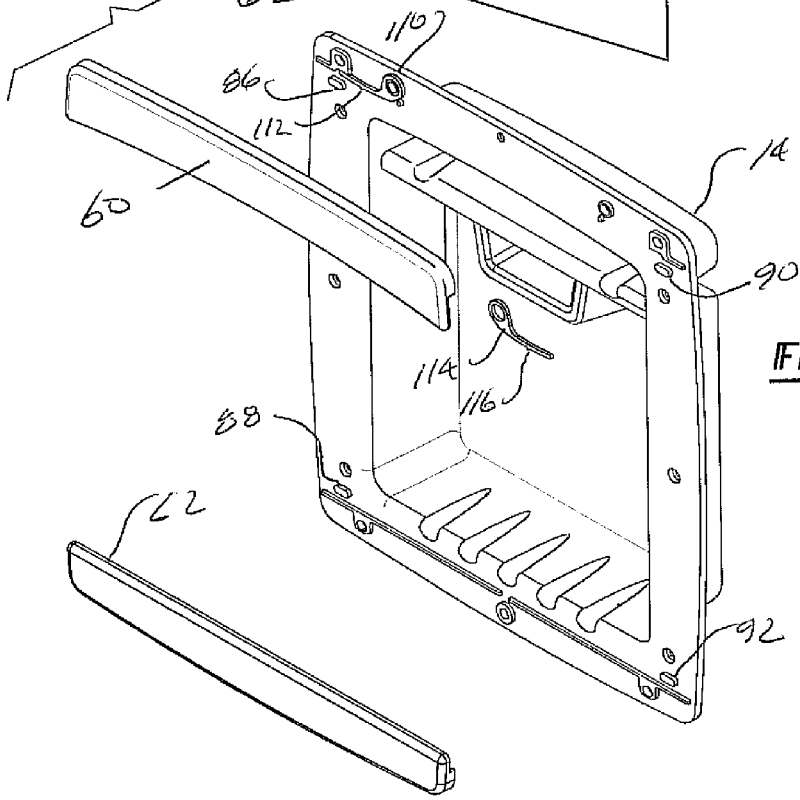
FIG. 7 is an exploded view of the preferred embodiment of the present invention and with parts removed for clarity.
Figure 10:
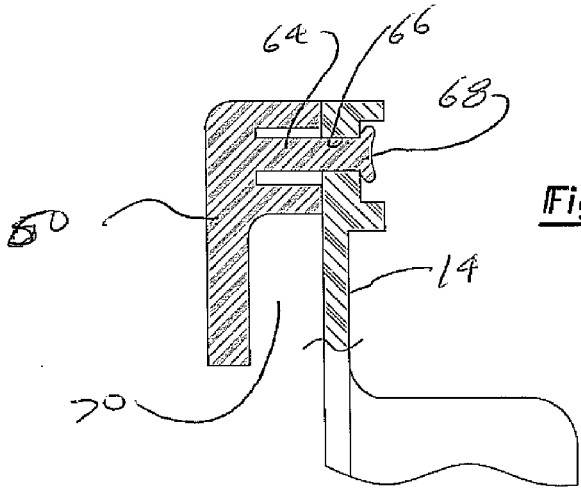
FIG. 10 is a partial sectional view illustrating the attachment of the bezels to the housing.
Figure 12:
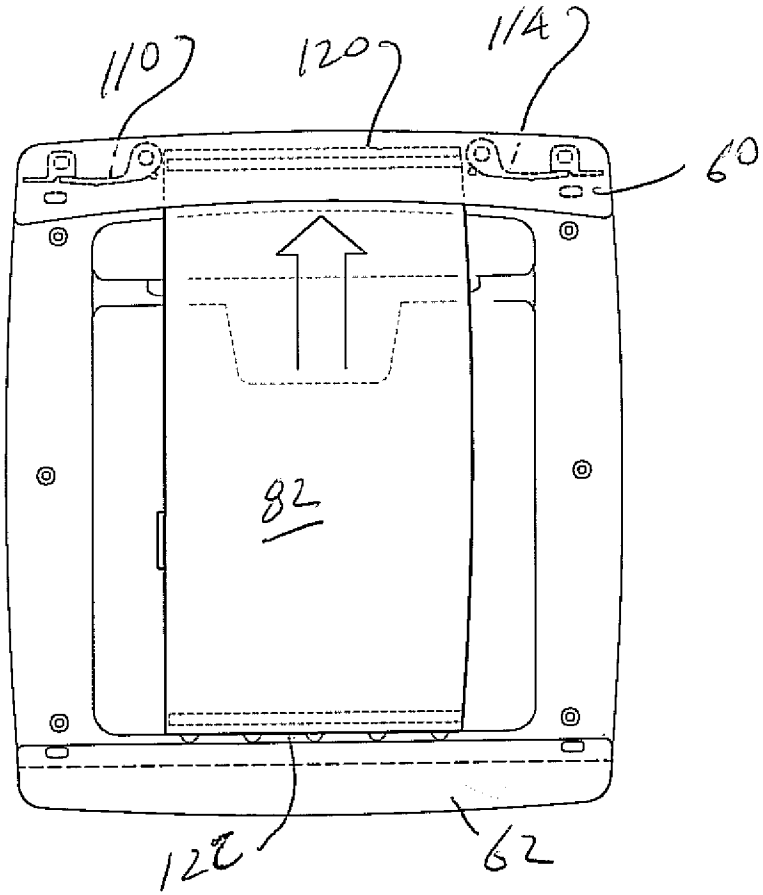
FIG. 11-FIG. 14 are front diagrammatic views illustrating the insertion of the doors onto the housing.

With reference now particularly to FIGS. 6, 7 and 10, a top bezel 60 is secured across the top of the housing 14 while, similarly, a bottom bezel 62 is secured along the bottom of the housing 14. Both bezels 60 and 62 are preferably made of plastic and preferably formed by injection molding.

Any conventional method may be utilized to secure the bezels 60 and 62 to the housing 14. However, as best shown in FIG. 10, each bezel 60 and 62 (only bezel 60 is shown in FIG. 10) includes a plurality of pins 64 which extend through positioning holes 66 formed in the housing 14. With the bezel 60 positioned against the housing 14 and the pins 64 extending through their alignment holes 66, the free ends 68 of the pins 64 are heat staked thus securing the bezels 60 and 62 to the housing 14.

As best shown in FIGS. 6 and 10, the upper bezel 60, when secured to the housing 14, forms a downward facing and laterally extending U-shaped upper track 70. Similarly, the lower bezel 62 forms a laterally extending and upwardly facing lower U-shaped track 72. Consequently, the tracks 70 and 72 face each other and each track 70 and 72 extends completely laterally across the housing in between the bezels 60 and 62 and the housing 14.

Figure 8:
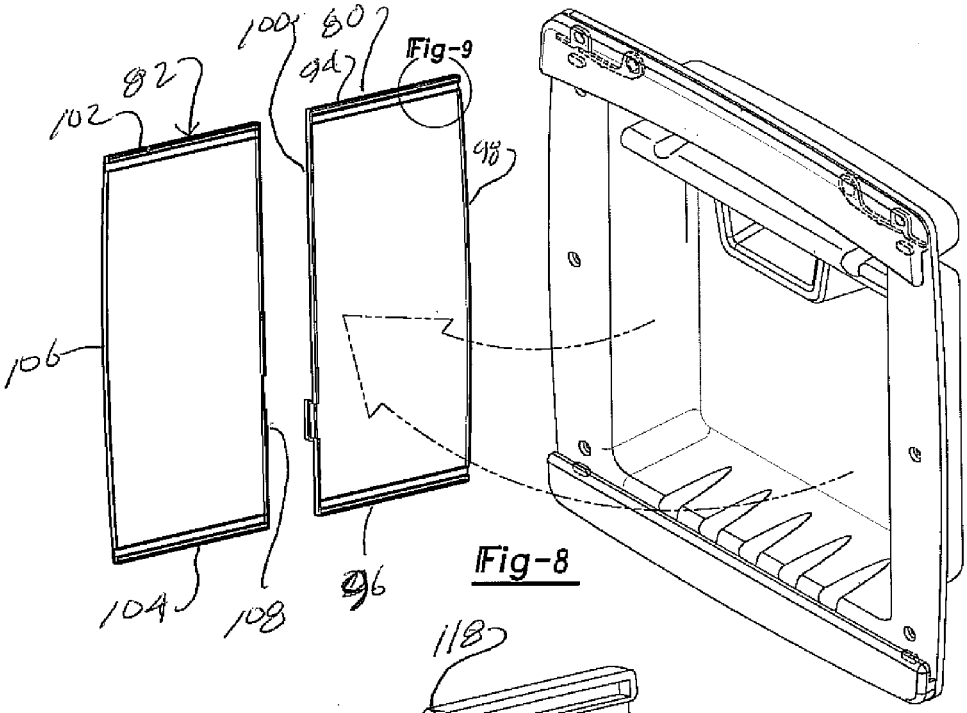
FIG. 8 is an exploded perspective view of the preferred embodiment of the invention.

With reference now to FIGS. 6 and 8, a planar left-hand door 80 is slidably mounted in the tracks 70 and 72 while, similarly, a right-hand door 82 is slidably mounted within the upper track 70 and lower track 72. The doors 80 and 82 are preferably substantially the same in size and each door 80 and 82 preferably includes a front mirrored surface 84.

As best shown in FIG. 7, an upper and a lower guide pin 86 and 88 are molded into the housing 14 along the left-hand side of the housing 14. Similar, upper and lower guide pins 90 and 92, respectively, protrude outwardly from the front face of the housing 14 adjacent the right-hand side of the housing 14.

As best shown in FIG. 8, an upper and lower guide channel 94 and 96 are provided along the top and bottom of the left-hand door 80, respectively. These guide channels 94 and 96 are open on the outside 98 of the door 80 but closed along their inner side 100. Similarly, the right-hand door 82 also includes upper and lower guide channels 102 and 104 which are open on their outwardly facing sides 106 of the door 82 but closed on the inside 108 of the door 82.

The guide channels 94 and 96 are spaced apart from each other by the same spacing as the left-hand guide pins 86 and 88. Consequently, with the door positioned in the guide channels 70 and 72 as shown in FIG. 6, the guide pins 86 and 88 extend into the guide channels 94 and 96 to both guide and support the left door 80. Furthermore, since the guide channels 94 and 96 are closed at their inner ends, the coaction between the guide pins 86 and 88 and their respective guide channels 94 and 96 prevents the left-hand door 80 from sliding outwardly and detaching from the housing 14.

The right-hand door 82 functions in a similar manner to the left-hand door 80, i.e. the guide channels 102 and 104 slidably receive their respective guide pins 90 and 92 which support and guide the right-hand door 82. Since the inside edge of each guide channel 102 and 104 is closed, the coaction between the guide pins 90 and 92 and the closed ends of the channels 102 and 104 prevents the right-hand door from detaching from the housing 14 when sliding outwardly relative to the housing 14.

Figure 9:
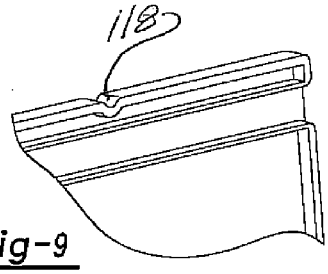
FIG. 9 is a view taken along circle 9-9 in FIG. 8 and enlarged for clarity.

As best shown in FIG. 7, a left resilient lever 110 having a detent 112 on its bottom is mounted to the housing 14 adjacent the left top of the housing 14. Similarly, a second resilient lever 114 having a detent 116 is mounted adjacent the top right of the housing 14. These detents engage a notch 118 (FIG. 9) formed along the top of each door adjacent its outer edge when each door is in its closed position. In their closed position, the doors 80 and 82 cover the open front of the housing 14 while, conversely, in their open position, the doors 80 and 82 enable access to the contents of the housing 14.

Figure 11:
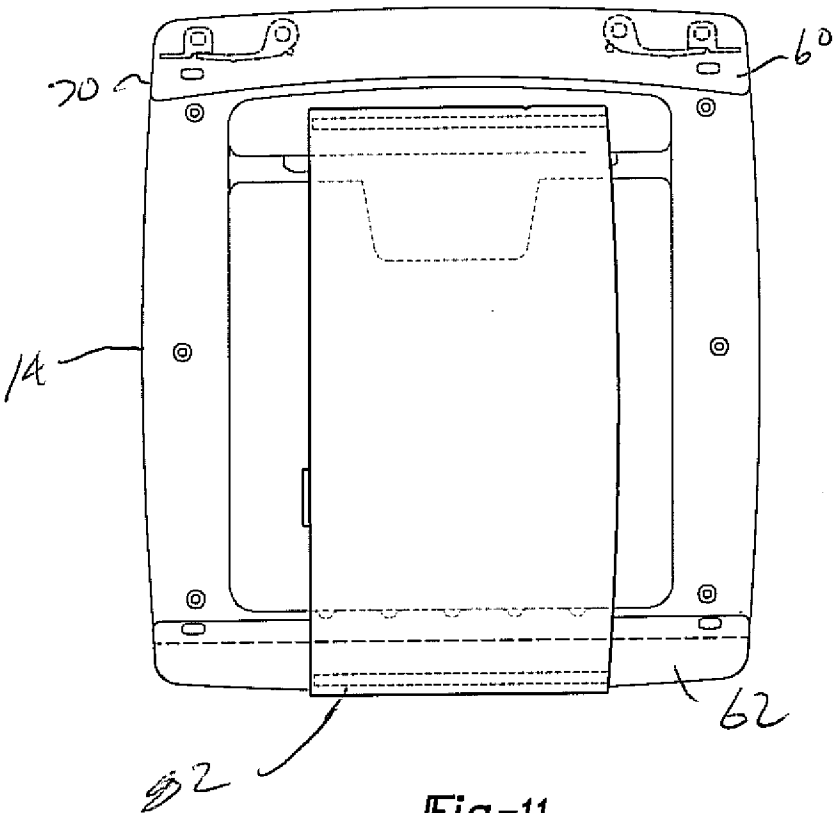

With reference now to FIGS. 11-14, the installation of the right-hand door 82 is illustrated, it being understood that the installation of the left-hand door constitutes a mirror image of the right-hand door installation. As shown in FIG. 11, the door is first positioned in alignment with the upper track 70 and then inserted above the track 70 to the position shown in FIG. 12. In the position shown in FIG. 12, the width of the door 82 is less than the spacing between the two levers 110 and 114 so that a top 120 of the door 82 extends above the upper track 70 so that a bottom 122 of the door 82 is positioned above the lower bezel 62.

The bottom 122 of the door 82 is then positioned within the lower housing track 72 where the bottom 122 of the door 82 is supported by the bottom bezel 62.

Figure 14:
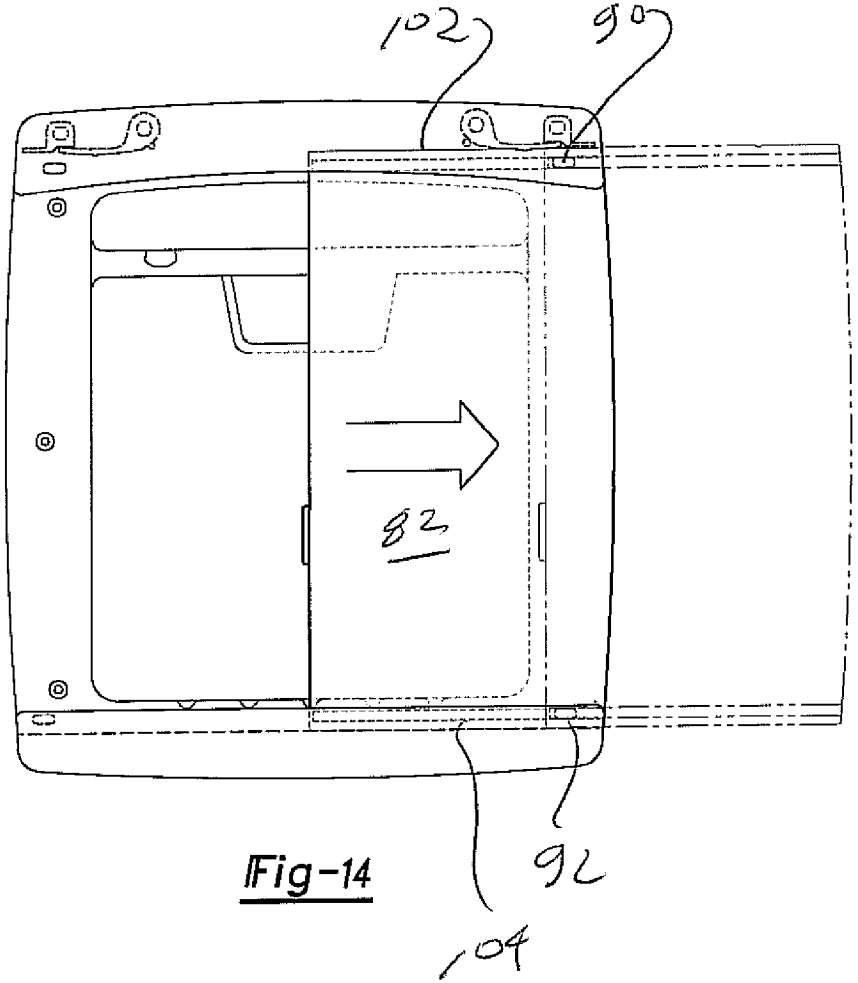
Figure 13:
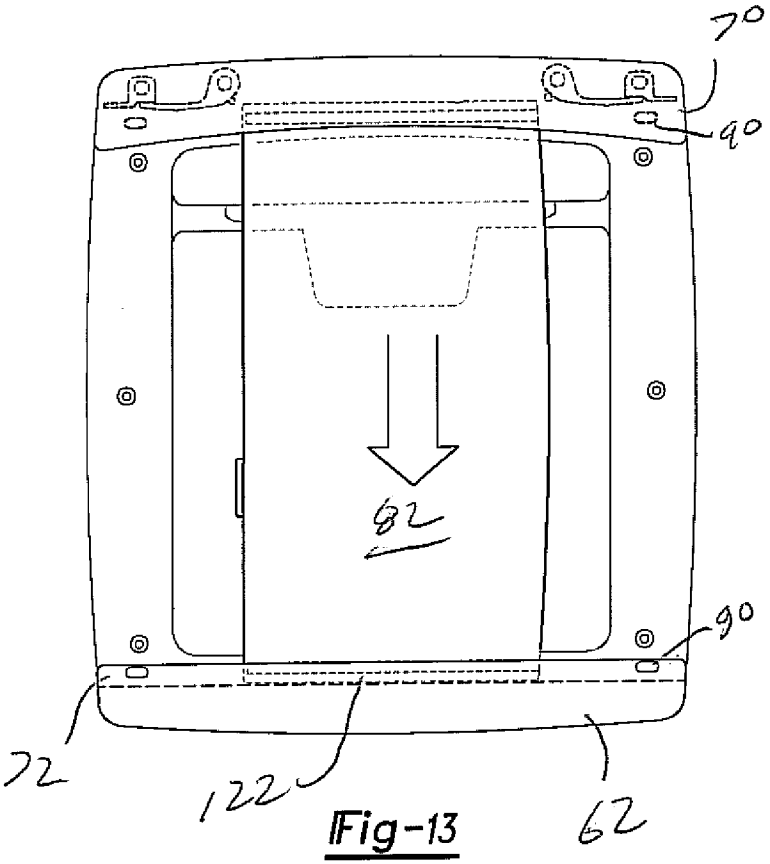

The door 82 is then shifted rightwardly as viewed in FIG. 14. In doing so, the guide pins slidably engage the upper and lower guide channels 102 and 104 in the door 82 to guide the door 82 as it is moved laterally outwardly away from the housing 14.

After the right-hand door 82 is mounted to the housing and shifted to its open position, the left-hand door 80 is then slidably mounted to the housing 14 in the same manner, except that the left-hand door is shifted leftwardly relative to the housing 14. The removal of the doors 80 and 82, of course, enables them to be cleaned as required.

From the foregoing, it can be seen that the present invention provides a simple and yet effective shower vanity for containing bathing products.

Having described my invention, however, many modifications thereto will become apparent to those skilled in the art to which it pertains without deviation from the spirit of the invention as defined by the scope of the appended claims.

I claim:

1. A shower vanity for use with a wall having spaced apart framing members comprising:

a housing dimensioned to be recessed between two adjacent framing members in the wall, said housing having an open front and forming a cavity dimensioned to contain bathing products, said housing having a front mounting flange which extends outwardly from said open front of said housing, said mounting flange dimensioned to flatly abut against the wall, a plurality of fasteners extending through said housing and into the framing member which secure said housing to the framing member, a laterally extending upper and lower track formed in said housing adjacent a top and a bottom of said housing, respectively, said tracks being U-shaped and facing each other, a pair of doors, each door having a top and a bottom elongated recessed guide channel, each guide channel closed at one end and open at its other end, said doors being slidable in said track between an open position in which said doors extend laterally outwardly from said housing, and a closed position in which said doors cover the front of said housing, a top and a bottom guide pin attached to each side of said housing, said top and said bottom guide pins on one side of said housing registering with said open ends of said top and bottom guide channel, respectively, of one of said doors, said top and said bottom guide pins on the other side of said housing registering with said open ends of said top and bottom guide channel, respectively, of the other of said doors, each said guide pin being slidably received in its associated guide channel as said doors are moved between said open and said closed position, said guide pins limiting the lateral outward extension of their associated door, wherein each door includes a notch in its top and a pair of resiliently biased detents mounted to said housing, said detents registering with said notches in said doors when said doors are in their respective closed positions.

2. The invention as defined in claim 1 wherein said upper track has an open top along a predetermined length of a central section of said upper track, said predetermined length being greater than the width of either door so that said doors are removable from said housing by aligning said door with said open top of said upper track and lifting said door upwardly and then outwardly from said housing.

3. The invention as defined in claim 1 wherein said housing is made of plastic.

4. The invention as defined in claim 3 and comprising a plastic shelf integrally formed with said housing.

5. The invention as defined in claim 1 and comprising an upper and a lower bezel attached to said housing, said tracks being formed between said bezels and said housing.

6. A shower vanity for use with a wall having spaced apart framing members comprising:

a housing dimensioned to be recessed between two adjacent framing members in the wall, said housing having an open front and forming a cavity dimensioned to contain bathing products, said housing having a front mounting flange which extends outwardly from said open front of said housing, said mounting flange dimensioned to flatly abut against the wall, a plurality of fasteners extending through said housing and into the framing member which secure said housing to the framing member, a laterally extending upper and lower track formed in said housing adjacent a top and a bottom of said housing, respectively, said tracks being U-shaped and facing each other, a pair of doors, each door having a top and a bottom elongated recessed guide channel, each guide channel closed at one end and open at its other end, said doors being slidable in said track between an open position in which said doors extend laterally outwardly from said housing, and a closed position in which said doors cover the front of said housing, a top and a bottom guide pin attached to each side of said housing, said top and said bottom guide pins on one side of said housing registering with said open ends of said top and bottom guide channel, respectively, of one of said doors, said top and said bottom guide pins on the other side of said housing registering with said open ends of said top and bottom guide channel, respectively, of the other of said doors, each said guide pin being slidably received in its associated guide channel as said doors are moved between said open and said closed position, said guide pins limiting the lateral outward extension of their associated door, wherein said upper track has an open top along a predetermined length of a central section of said upper track, said predetermined length being greater than the width of either door so that said doors are removable from said housing by aligning said door with said open top of said upper track and lifting said door upwardly and then outwardly from said housing.

7. The invention as defined in claim 6 wherein said housing is made of plastic.

8. The invention as defined in claim 7 and comprising a plastic shelf integrally formed with said housing.

9. The invention as defined in claim 6 and comprising an upper and a lower bezel attached to said housing, said tracks being formed between said bezels and said housing.

* * * * *